United States Patent [19]

DeMarco

[11] 4,350,175

[45] Sep. 21, 1982

[54] FOLDING UMBRELLA

[76] Inventor: Joseph H. DeMarco, 60 Seaman Ave., New York, N.Y. 10034

[21] Appl. No.: 190,471

[22] Filed: Sep. 24, 1980

Related U.S. Application Data

[63] Continuation-in-part of Ser. No. 74,393, Sep. 10, 1979, abandoned.

[51] Int. Cl.[3] ..... A45B 25/18; A45B 25/24

[52] U.S. Cl. ..... 135/33 C; 135/34

[58] Field of Search ..... 135/33 R, 33 C, 34

[56] References Cited

U.S. PATENT DOCUMENTS

| | | | |
|---|---|---|---|
| 1,310,399 | 7/1919 | Levin | 135/33 C |
| 1,781,479 | 11/1930 | Schwartz | 135/33 C |
| 1,937,363 | 11/1933 | Seraphim | 135/33 C |
| 2,545,022 | 3/1951 | Crewdson | 135/33 C |
| 2,742,913 | 4/1956 | Weisblatt | 135/33 C |
| 3,379,201 | 4/1968 | Lynch | 135/33 C |
| 3,874,397 | 4/1975 | Oberhaus | 135/25 R X |
| 4,007,753 | 2/1977 | DeMarco | 135/25 R |

*Primary Examiner*—J. Karl Bell

*Attorney, Agent, or Firm*—Bauer & Amer

[57] ABSTRACT

Folding umbrellas which close into a compact condition, for convenience in storage and portability are, of course, well known. To such umbrella, having the characterizing closing mode in which lower rib portions fold bodily against upper rib portions, there are provided, in one embodiment, cooperating closure panels which move towards each other from opposite sides against the bodily folded ribs and are joined to each other, by snaps, zipper, or the like, so as to effectively serve as an integral cover for the umbrella and, in another embodiment, a sock-like tube which is pulled over the folded-closed umbrella thereby serving as a closure for same.

1 Claim, 15 Drawing Figures

FIG.1A
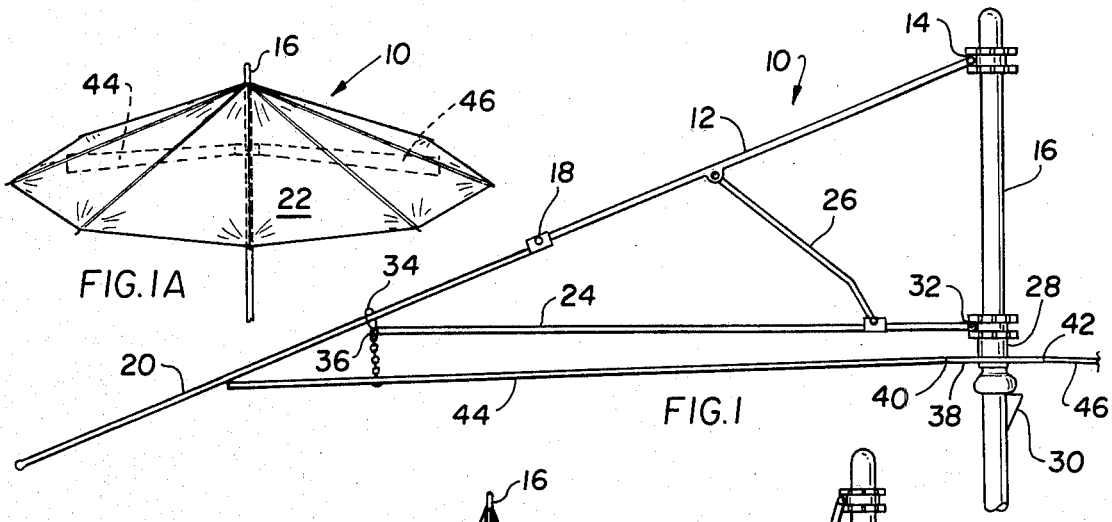
FIG.1
FIG.2A
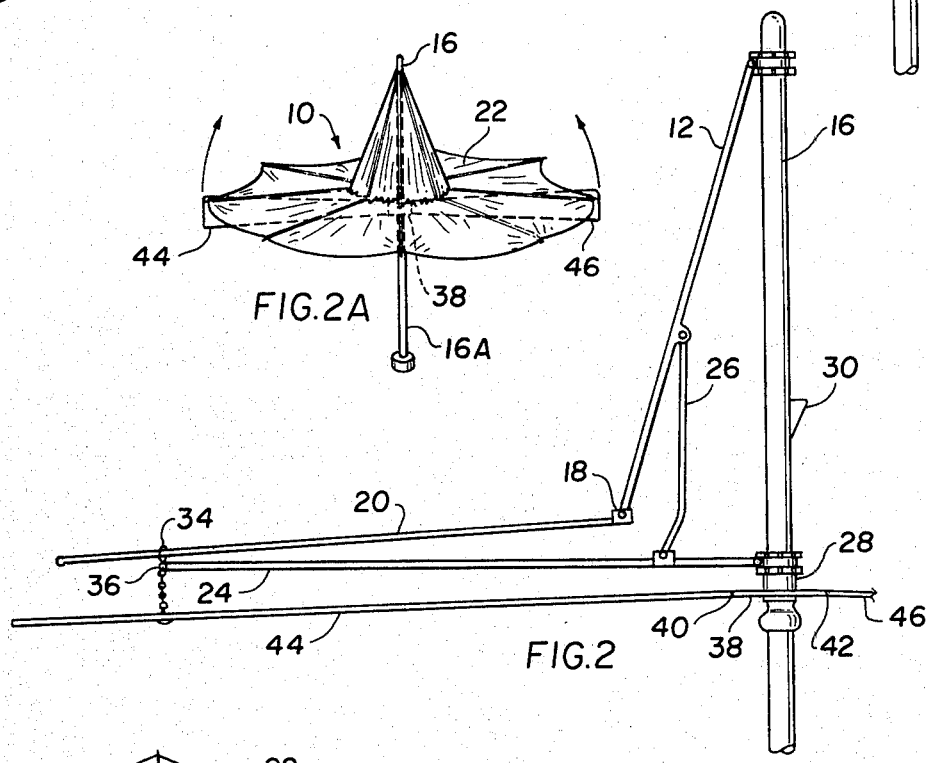
FIG.2
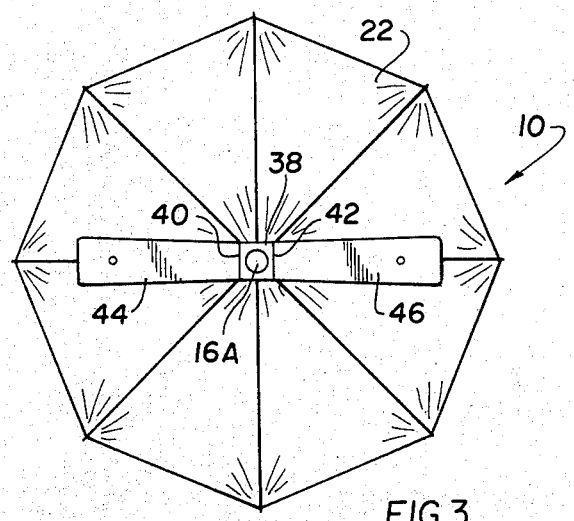
FIG.3

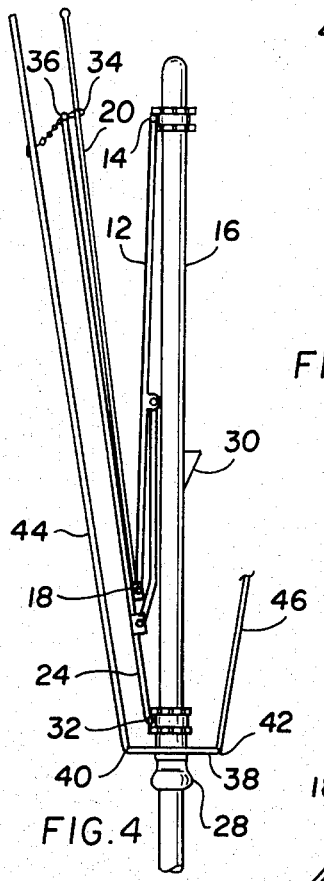
FIG. 4
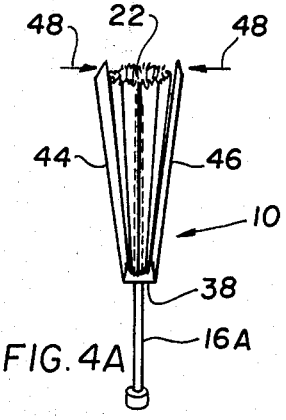
FIG. 4A
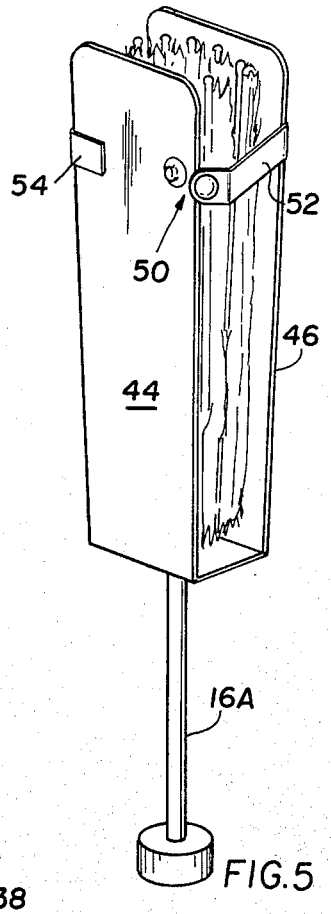
FIG. 5
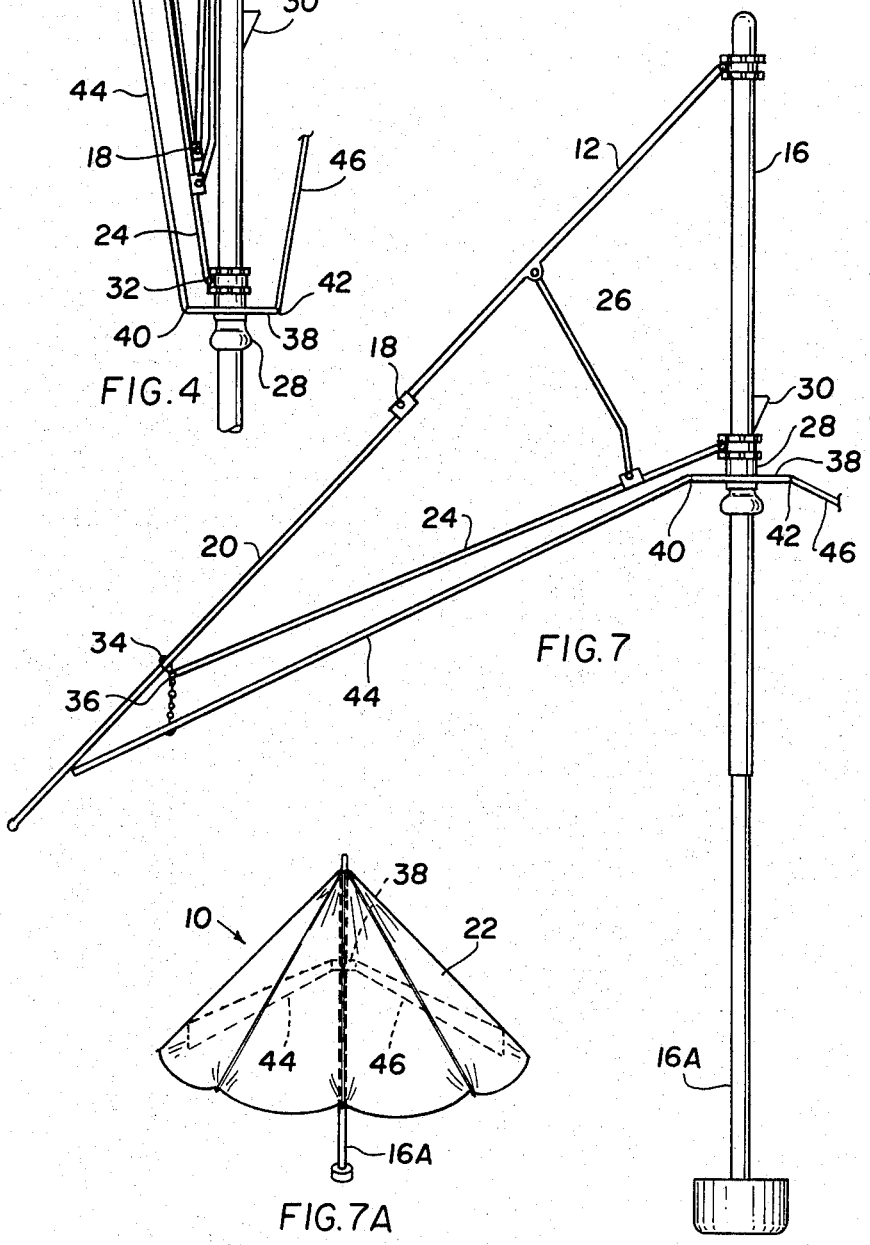
FIG. 7
FIG. 7A
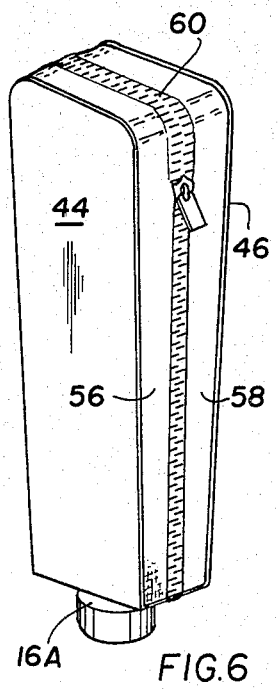
FIG. 6

FOLDING UMBRELLA

This application is a continuation-in-part application of Ser. No. 74,393, filed Sept. 10, 1979 now abandoned.

The present invention relates generally to folding umbrellas, of that particular classification described and illustrated in U.S. Pat. No. 4,007,753, and more specifically to improvements for same that utilize to full advantage the characterizing closing mode of the umbrella to provide an integral cover for same and thereby further adding to the convenience in the storing and portability of the umbrella.

One well known type of folding umbrella, as exemplified by that described and illustrated in U.S. Pat. No. 4,007,753, assumes a compact, closed condition as a result of the cover-supporting ribs thereof bodily folding together, and such folded ribs then closing upon the umbrella central rod. Underlying the present invention is the recognition that this closing or folding mode can impart a closing movement to closure panels that advantageously can be used to provide an integral cover to the umbrella. Moreoever, until this umbrella type is folded closed, it is further recognized that the closure panels are in an out-of-the-way position, and thus do not interfere with the normal, intended use of the umbrella.

Broadly, it is an object of the present invention to further enhance the convenience aspects of a folding umbrella by additional use of the closing mode thereof. Specifically, in one preferred embodiment it is an object to have panels close upon the umbrella rib structure, as a further consequence of the closing movement of said rib structure, such that said panels effectively serve as a protective, integral cover for the umbrella.

As already noted, the within invention is applied to a folding umbrella of the type having a central rod-type handle and circumferentially spaced ribs hingedly connected adjacent the top of said handle, each of said ribs being further hinged at a medial location therealong and operationally disposed to fold bodily upon itself during the folding of said umbrella into a compact storage condition, said invention residing in certain improvements to such folding umbrella that provides an integral cover for same. As is more particularly detailed subsequently herein, the improvements which demonstrate objects and advantages of the present invention include a central panel attached to the handle at a location therealong below the ribs in their bodily folded condition. A cooperating pair of closure panels are foldably attached on opposite sides of the central panel and means are provided for interconnecting the remote end of each said closure panel to at least a selected cooperating one said folding rib, with the result that said closure panels are urged through closing movement towards each other incident to the bodily folding of the ribs. In the within umbrella as just generally described therefor, the closure panels are advantageously positioned so they end up in covering relation on opposite sides of the bodily folded ribs, to thereby contribute to providing an integral, protective cover to the umbrella.

In another preferred embodiment use is made of a sock-like fabric tube, instead of the closure panels, which tube is pulled in covering relation over the folded-closed umbrella.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein:

FIG. 1 is a partial side elevational view illustrating structural details of the ribs of the within improved umbrella;

FIG. 1A is a perspective view, on a reduced scale, illustrating the umbrella in conjunction with a weather barrier or cover in supported relation on the umbrella ribs;

FIG. 2 is a view similar to FIG. 1 illustrating the umbrella ribs in a partially closed condition;

Figures 8, 9, 10A, 10B:
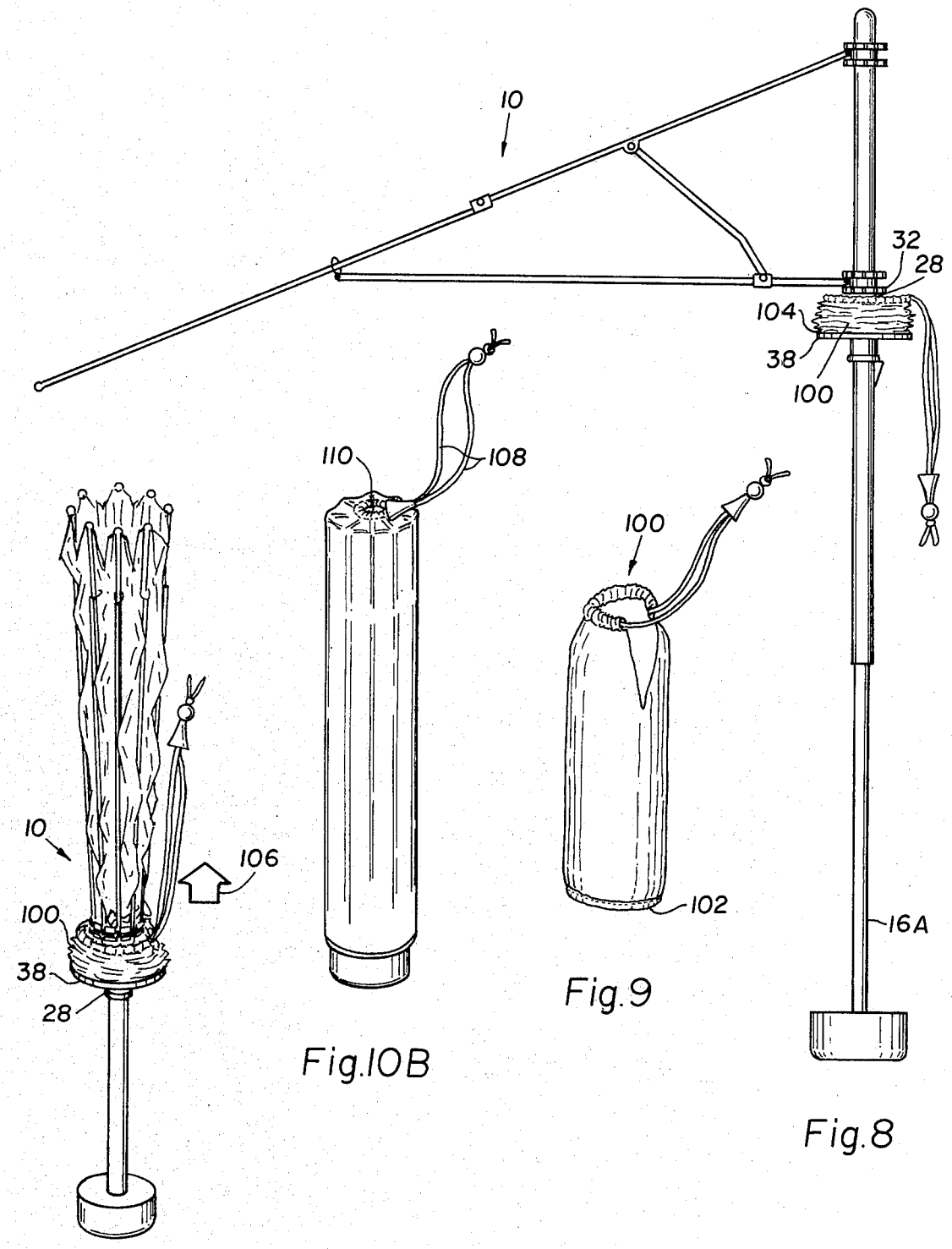

FIG. 2A, like FIG. 1A, is a partial perspective view of the umbrella in its commercial form and in the partially closed condition as illustrated in FIG. 2;

FIG. 3 is a view of the umbrella in its fully opened condition as illustrated in FIG. 1A, but as seen from below in order to illustrate in full line structural details shown in phantom line perspective in FIG. 1A;

FIGS. 4 and 4A are similar, respectively, to FIGS. 2 and 2A, except that they illustrate the within umbrella in an almost closed condition;

FIG. 5 is a perspective view illustrating one embodiment of the within improved umbrella in its completely closed condition;

FIG. 6 is a perspective view similar to FIG. 5, but of a second embodiment; and FIGS. 7 and 7A are related views, similar to FIGS. 2, 2A, for example, but illustrating the movable components of the umbrella at different positions of movement.

In remaining FIGS. 8–10B there is illustrated still another embodiment of an improved folding umbrella according to the present invention in which a sock-like fabric tube is used as a closure for the folded-closed umbrella. More particularly, FIG. 8 is a partial side elevational view illustrating structural details of this additional inventive embodiment;

FIG. 9 is a perspective view of the sock-like tube prior to attachment to the umbrella; and FIGS. 10A and 10B are perspective views illustrating the manner in which the sock-like tube is pulled in covering relation over the folded-closed umbrella.

As is well understood, there is a classification of folding umbrellas of the type in which the lower section closes upon an upper section as both these sections close upon the umbrella rod, such movement in the sections occurring as a result of articulating or pivotal movement of the umbrella ribs. The aforesaid well known classification of folding umbrellas is exemplified by prior U.S. Pat. No. 4,007,753 which, by the reference just made thereto, is intended to be incorporated in its entirety herein. That is, the manner in which the umbrella folds so that a lower or peripheral section moves bodily against an upper section, namely the one hingedly attached to the top of the umbrella rod, and both said sections move against the umbrella rod during the closing of the umbrella, is believed to be described in such sufficient detail in said U.S. Pat. No. 4,007,753 that it is unnecessary, for a complete understanding of the within invention, to repeat said description except in passing and in a general manner.

Stated another way, the bodily folding of the umbrella ribs as above described is not the thrust of the within invention. Rather, the within invention is the recognition that in such a folding umbrella of the type referred to and described in said U.S. Pat. No. 4,007,753, that there can be advantageously embodied as part of the umbrella closure panels which effectively serve as an integral cover for the umbrella when the umbrella ribs assume their compact folded condition against the umbrella rod, all as will now be described in detail.

EMBODIMENT OF FIGS. 1-5

Referring to the first embodiment of the within improved umbrella as illustrated in FIGS. 1-5, respectively, said umbrella, generally designated 10, has a characteristic closing action that may be readily discerned by progressive examination of FIGS. 1, 2, 4 and 5. Thus, starting with FIG. 1, and as further amplified by corresponding FIG. 1A, umbrella 10 includes a circumferential arrangement of upper section umbrella ribs, individually and collectively designated 12, hingedly connected, as at 14, adjacent the upper end of the umbrella rod 16. At its opposite end, as at 18, there is a hinged connection to a lower section of umbrella ribs, individually and collectively designated 20. Thus, ribs 20 are an extension of ribs 12 and cooperate with each other to provide support for a weather barrier or cover 22 of suitable material, such as fabric, plastic or the like.

To effectuate closing of the umbrella as above described, wherein the lower section ribs 20 bodily fold upon the upper section ribs 12 as both said sections 12, 20 themselves fold and move into a position adjacent the umbrella rod 16, use is made in the umbrella 10 of umbrella-closing struts 24 and 26, and a slide 28. With respect to components 24, 26 and 28, umbrella 10 hereof differs from the patented umbrella of referred to U.S. Pat. No. 4,007,753 which uses a somewhat different cooperative arrangement of components, but such components as are used in said patented umbrella and the just referred to components 24, 26 and 28 will be understood to be mechanically equivalent. In any event, the particular structure used for bodily folding umbrella ribs 20 upon ribs 12 is not the essence of the within invention.

To follow the operation of the rib-folding mechanism progressive examination should be made of FIGS. 1 and 2 and, of course, associated FIGS. 1A and 2A. The referred to operation is initiated by depressing the conventional spring-biased stop 30 which releases the slide 28 for downward movement along the rod 16. In response to such movement, or at least the initial portion thereof as illustrated in FIG. 2, strut 26 is projected into a more vertical orientation and has the effect of urging its cooperating upper rib 12 into closing movement against rod 16 and in initiating its cooperating lower rib 12 into a clockwise pivotal traverse about hinge 18 which, as already noted, results in said rib 20 bodily folding upon rib 12.

In response to continued downward movement of slide 28 for the further distance as illustrated in FIG. 4, there will be produced, in a manner which is well understood, the closed folded condition for the umbrella ribs as illustrated in FIG. 4. Said terminal closing movement is also essentially the result of the pivotal traverse of strut 24 about its pivot connection 32 to slide 28. This pivotal traversing movement in strut 24 in effect pushes the cooperating lower rib 20 into a bodily folded condition against an upper rib 12. To keep each cooperating pair of a movement-imparting strut 24 in alignment with a cooperating lower rib 20 use is made of a loop 34 attached as at 36 to the end of strut 24, through which each cooperating lower rib 20 is projected.

The manner by which ribs 20 bodily fold upon ribs 12, and said ribs 20, 12 themselves fold upon rod 16, as just described, as already indicated does not form an essential part of the present invention except that this closing or folding movement is a characterizing operational attribute of umbrella 10 embodying the present invention.

More particularly, the present invention as applied to umbrella 10 consists of the structural features and of the operation of such features as will now be described. The same includes a panel 38 which, by position, is in a central location also occupied by the rod 16, said central panel 38 being affixed in an appropriate manner to slide 28 of the rod 16. At opposite edges, as at 40 and 42, and as is perhaps best illustrated in FIG. 3, central panel 38 has an appropriate connection which permits articulation or folding movement in a connected pair of closure panels 44 and 46. Each closure panel 44 and 46 is generally rectangular, as illustrated in FIG. 5, and by articulating connections 40 and 42 it is meant that these panels have a degree of folding movement from opposite directions, designated 48 in FIG. 4A, which maintains the lower umbrella ribs 20 in bodily folded condition against ribs 12 and both said ribs folded against the rod 16. In the embodiment illustrated in FIG. 5 this is actually achieved by manually depressing the closure panels 44 and 46 together and engaging together male and female snap fasteners 50, one such fastener being on the closure panel 44 and the other at the end of a strap 52 attached to the closure panel 44, as at 54, and of sufficient length to encircle the folded construction, all as is clearly illustrated in FIG. 5.

EMBODIMENT OF FIG. 6

At this point in the description it is convenient to note that in another contemplated embodiment of the invention, namely that illustrated in FIG. 6, that the closure panels 44 and 46 are provided with strips of fabric 56 and 58 appropriately connected about their periphery, which strips are provided with a zipper 60 along their confronting edges. Also readily noted by comparison of FIGS. 5 and 6 is that the lower length portion of the rod 16, designated 16A in these figures, is preferably telescoped within the upper rod portion so that it can be pushed therein so as to assume the compact condition illustrated in FIG. 6.

EMBODIMENT OF FIGS. 8-10B

As a substitute for the closure panels 44 and 46, there can be use of a sock-like fabric tube 100 as shown in isolated perspective in FIG. 9. The bottom opening 102 of tube 100 is connected, as at 104, to the top of the central panel 38 in any appropriate manner, said central panel 38, as already explained in connection with the previously described embodiments being made an integral part of the umbrella slide 28. As a consequence, and as clearly illustrated in FIG. 8, in the open or unfolded condition of umbrella 10 the sock 100 occupies an out-of-the-way storage position about slide 28 between the slide central panel 38 on its lower side and the rib-attaching flange 32 thereof at its upper side.

As shown in progressive sequence in FIGS. 10A and 10B, after umbrella 10 is placed in its folded-closed condition (FIG. 10A), the fabric tube 100 is pulled upward, as in the direction 106, in covering relation over the folded-closed umbrella, all as is clearly illustrated in FIG. 10B. A drawstring 108 is then advantageously used to close the tube upper opening 110, and the bottom telescoping rod 16A pushed up into the rod length portion 16 to there provide the umbrella 10 with the compact storage condition illustrated in FIG. 10B.

For completeness' sake it is mentioned that a preferred construction material for the sock 100 is an elastic or similar fabric.

From the foregoing it should be readily appreciated that there has been described herein improved umbrella embodiments having the characteristic folding action as noted which are further embodied, in one embodiment, with closure panels 44 and 46 and, in another embodiment, with a fabric tube 100, both of which provide an integral cover for the umbrella.

EMBODIMENT OF FIG. 7A

In passing it is noted, in particular conjunction with FIGS. 7 and 7A, that there may be instances in which the user may want to those the umbrella in the conventional way in which the ribs 12, 20 are merely folded upon the rod 16 but not bodily folded upon themselves. FIGS. 7 and 7A demonstrate that this method of closing is possible and, more particularly, is not interfered with by the presence of the closure panels 44 and 46. This is because the articulating connections 40 and 42 of the closure panels 44, 46 to the central panel 38 allow a degree of pivotal traversing movement in the opposite direction which results in the closure panels 44 and 46 being moved adjacent the umbrella rods 16, 16A, and the rib struts folded against these panels. This closing mode, however, must be achieved manually. In practice, the user is thus required to release slide 28 to a position just slightly below stop 30, which is the position illustrated in FIGS. 7 and 7A, and then manually complete the conventional closing of the umbrella.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. In a folding umbrella of the type having a central rod and circumferentially spaced ribs hingedly connected adjacent the top of said rod, each of said ribs being further hinged at a medial location therealong and operationally disposed to fold bodily upon itself during the folding of said umbrella into a compact storage condition, the improvements to such folding umbrella serving as an integral cover for same comprising a slide member slidably disposed on said central rod, said slide member having a hinge-supporting structure adjacent the upper end thereof for completing hinge connections to said ribs and a centrally positioned panel disposed thereon in a clearance position below said hinge-supporting structure, and a fabric tube connected in encircling relation about said slide between said hinge-supporting structure and said panel, whereby said fabric tube is in an out-of-the-way position during use of said umbrella and during non-use thereof is advantageously positioned to be pulled in covering relation up over said bodily folded to thereby contribute to providing a protective cover for said umbrella.

* * * * *